United States Patent [19]

Ohtaki et al.

[11] Patent Number: 4,655,181

[45] Date of Patent: Apr. 7, 1987

[54] AIR-FUEL RATIO CONTROL SYSTEM

[75] Inventors: Kiyoshi Ohtaki, Fuchu; Kazuo Hara, Musashino, both of Japan

[73] Assignee: Fuji Jukogyo Kabushiki Kaisha, Tokyo, Japan

[21] Appl. No.: 787,416

[22] Filed: Oct. 15, 1985

[30] Foreign Application Priority Data

Oct. 22, 1984 [JP] Japan ..... 59-222627

[51] Int. Cl.[4] ..... F02M 7/00; F02B 3/00

[52] U.S. Cl. ..... 123/440; 123/438

[58] Field of Search ..... 123/440, 438, 489, 492; 364/431

[56] References Cited

U.S. PATENT DOCUMENTS

| | | | |
|---|---|---|---|
| Re. 29,741 | 8/1978 | Norimatsu et al. | 364/431 |
| 3,949,551 | 4/1976 | Eichler | 60/270 |
| 4,040,394 | 8/1977 | Wahl et al. | 123/489 |
| 4,109,615 | 8/1978 | Asano | 123/440 |
| 4,375,211 | 3/1983 | Ohara et al. | 123/440 |
| 4,398,517 | 8/1983 | Kubota et al. | 123/440 |
| 4,476,834 | 10/1984 | Nakazato | 123/440 |
| 4,483,296 | 11/1984 | Kataoka | 123/440 |
| 4,542,729 | 9/1985 | Yamato et al. | 123/489 |

*Primary Examiner*—Raymond A. Nelli

*Attorney, Agent, or Firm*—Martin A. Farber

[57] ABSTRACT

An air-fuel ratio control system for an internal combustion engine has an electromagnetic valve for correcting the air-fuel ratio of air-fuel mixture, and an $O_2$ sensor for detecting oxygen concentration in exhaust gases. An engine coolant temperature sensor is provided for producing an engine temperature signal when the temperature is higher than a predetermined value, and an $O_2$ sensor condition detecting circuit is provided for producing a non-activation signal when the $O_2$ sensor is not activated. Engine restart operation is detected by the engine temperature signal and non-activation signal. When the restarting of the engine detected, pulses with a duty ratio of which is dependent on the coolant temperature are applied to the electromagnetic valve, so as to prevent extreme enrichment of the air-fuel mixture.

8 Claims, 6 Drawing Figures

AIR-FUEL RATIO CONTROL SYSTEM

BACKGROUND OF THE INVENTION

The present invention relates to an air-fuel ratio control system for an internal combustion engine, which system controls the air-fuel mixture to the stoichiometric air-fuel ratio, at which ratio a three-way catalyst acts most effectively.

In a known air-fuel ratio control system for a motor vehicle, the air-fuel ratio of the air-fuel mixture burned in the engine cylinders is detected as the oxygen concentration in the exhaust gases by means of an $O_2$ sensor provided in the exhaust system of the engine, and a decision is made dependent on the output signal from the $O_2$ sensor which indicates whether the air-fuel ratio is richer or leaner than the value corresponding to the stoichiometric air-fuel ratio for producing a control signal. The control signal is applied to a proportion and integration circuit (PI circuit), the output of which is changed to pulse form. The pulses operate an electromagnetic valve so as to control the amount of bleed air in a carburetor for controlling the air-fuel ratio of the mixture. When the duty ratio of the pulses is reduced, the air-fuel mixture is enriched. Thus, the air-fuel ratio is controlled to the stoichiometric air-fuel ratio at which a three-way catalyst in the exhaust system acts most effectively. In such an air-fuel ratio control system, when the temperature of a sensor body of the $O_2$ sensor is lower than a predetermined temperature, the $O_2$ sensor does not act as a sensor. Accordingly, until the $O_2$ sensor is activated by the temperature of the exhaust gases, the duty ratio of the pulses is fixed to a predetermined value which is selected to control the air-fuel ratio under conditions of combustion at low temperature (25° C.) of the engine. When the operation of the engine is stopped, the temperature of the sensor decreases quickly compared with the temperature of the engine including the carburetor. When the engine is restarted while the engine temperature is at high temperature, the carburetor supplies a rich air-fuel mixture to the engine because of the high temperature of the body of the carburetor. On the other hand, if the $O_2$ sensor is not activated, the duty ratio is fixed, which means that the feedback control system does not operate. As a result, the air-fuel mixture is extremely enriched. The rich mixture will cause difficulty in starting the engine, high exhaust emissions, poor fuel economy, and other problems.

SUMMARY OF THE INVENTION

The object of the present invention is to provide an air-fuel ratio control system which operates to correct the air-fuel ratio when restarting of an engine at high engine temperature, thereby eliminating the above described problems.

Other objects and features of this invention will become understood from the following description with reference to the accompanying drawings.

DETAILED DESCRIPTION OF THE PREFERRED EMBODIMENT

Figure 1:
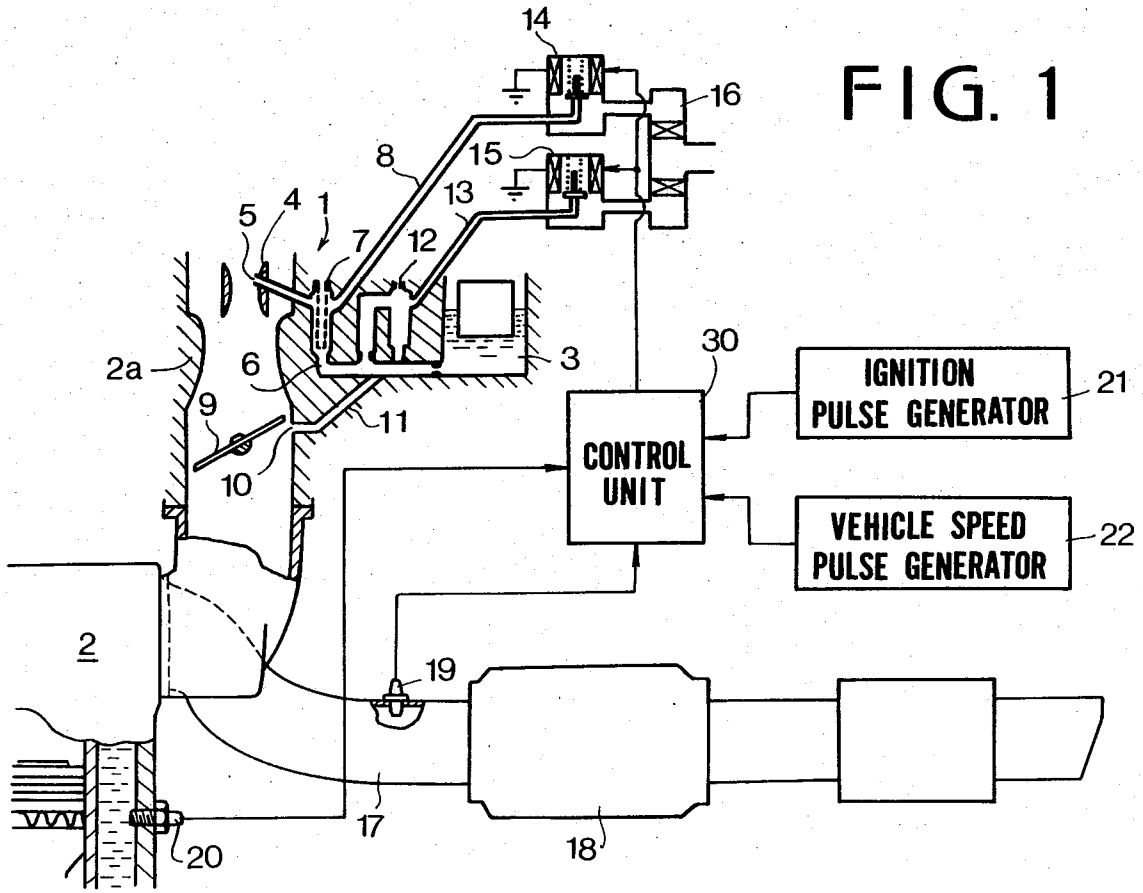
FIG. 1 is a schematic explanatory view of an air-fuel ratio control system according to the present invention.

Referring to FIG. 1, a carburetor 1 is provided adjacent to an intake manifold 2*a* of an internal combustion engine 2. A correcting air passage 8 communicates with an air-bleed 7 which is provided in a main fuel passage 6 between a float chamber 3 and a nozzle 5 in a venturi 4. Another correcting air passage 13 communicates with another air-bleed 12 which is provided in an idle fuel passage 11 which diverges from the main fuel passage 6 and extends to an idle port 10 in the vicinity of a throttle valve 9. These correcting air passages 8 and 13 communicate with on-off type electromagnetic valves 14, 15, the induction sides of which are in communication with the atmosphere through an air filter 16. A three-way catalytic converter 18 is provided in an exhaust pipe 17 downstream of the engine, and an $O_2$ sensor 19 is provided between the engine 2 and the converter 18 to detect the oxygen concentration of exhaust gases of the engine when the air-fuel mixture is burned in the engine. A coolant temperature sensor 20 is provided on a water jacket of the engine.

The outputs of the $O_2$ sensor 19, coolant temperature sensor 20, an ignition pulse generator 21, and a vehicle speed pulse generator 22 are sent to a control unit 30 which produces an output signal to actuate electromagnetic valves 14, 15 to open and close them at duty ratios. Thus, either considerable air is supplied to the fuel system through the air correcting passages 8, 13 to produce a lean air-fuel mixture or only a small amount of air is supplied to the system so as to enrich the air-fuel mixture.

Figure 2A:
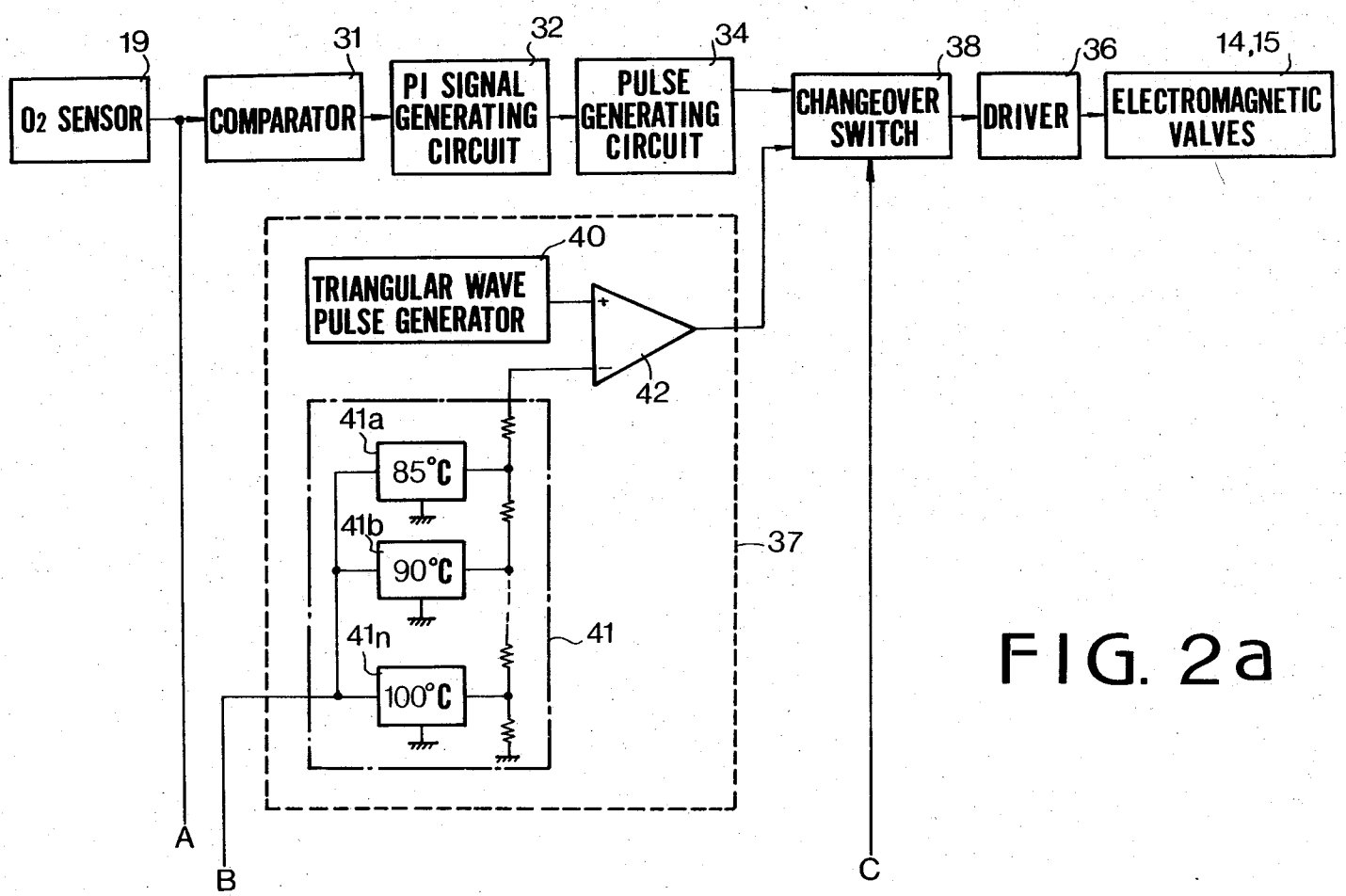
FIGS. 2*a* and 2*b* show a block diagram of the electric control circuit of the present invention.
Figure 2B:
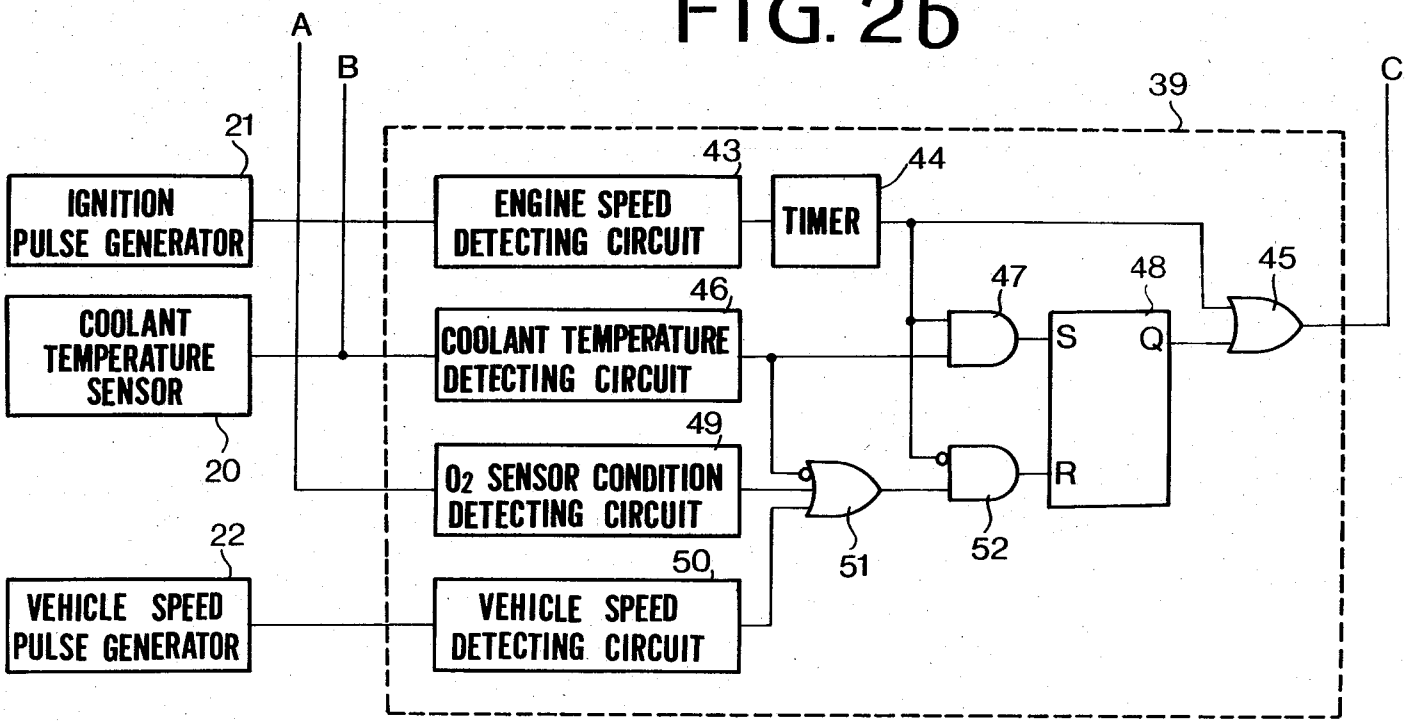

FIGS. 2*a* and 2*b* show the construction of the control unit 30 including a feedback control circuit. The output of the $O_2$ sensor 19 is applied to a PI(proportion and integration) signal generating circuit 32 through a comparator 31.

Generally, the air-fuel ratio varies cyclically with respect to the stoichiometric air-fuel ratio. Accordingly, the output of the $O_2$ sensor 19 has a waveform having a wavelength. The output is compared with a reference value at the comparator 31 which produces pulses dependent on the waveform. The pulses are applied to the PI signal generating circuit 32, so that the PI circuit 32 produces an output signal comprising a proportion component and integration component. The output of the circuit 32 is applied to a pulse generating circuit 34 which compares the output of the circuit 32 with triangular wave pulses and produces square wave pulses. The square wave pulses are supplied to the electromagnetic valves 14,15 via a changeover switch 38 and a driver 36 for operating the valves 14 and 15.

When rich air-fuel mixture is detected, the pulse generating circuit 34 produces pulses having large duty ratios so as to operate the valves 14 and 15 at large duty ratios to dilute the mixture. At lean air-fuel mixtures, the circuit 34 produces pulses having small duty ratios to enrich the mixture.

The system of the invention is provided with a fixed duty ratio pulse generating circuit 37 and an engine restart detecting circuit 39. The fixed duty ratio pulse generating circuit 37 comprises a triangular wave pulse generator 40, a comparator 42, and a reference value setting circuit 41 comprising a plurality of switching circuits 41*a*, 41*b*–41*n* connected to a voltage divider for changing the voltage applied to an inverting input of the comparator 42. Each of gates of the switching circuits is connected to the coolant temperature sensor 20. Each switching circuit operates to connect a corresponding resistor to the ground when the temperature of the coolant reaches a temperature determined for the switching circuit.

The engine restart detecting circuit 39 comprises an engine speed detecting circuit 43 which is applied with ignition pulses from the ignition pulse generator 21. The engine speed detecting circuit 43 produces an output until engine speed reaches a predetermined value (200 rmp). The output is applied to a timer 44 which produces a high level output and the high level output becomes a low level when the output of the engine speed detecting circuit continues for a predetermined period (three seconds). The output of the timer 44 is applied to an OR gate 45 and AND gates 47 and 52, and the outputs of AND gates 47 and 52 are applied to set and reset terminals S and R of a flip-flop 48, respectively. The output of the flip-flop 48 is applied to the OR gate 45.

The engine restart detecting circuit 39 further comprises a coolant temperature detecting circuit 46, an $O_2$ sensor condition detecting circuit 49, and a vehicle speed detecting circuit 50. The coolant temperature detecting circuit 46 is applied with the output of the coolant temperature sensor 20 and produces a high level output when the temperature rises above 80° C. The output of the circuit 46 is applied to AND gate 47 and OR gate 51. The $O_2$ sensor condition detecting circuit 49 is applied with the output of the $O_2$ sensor 19 and produces a high level output when the output of the $O_2$ sensor exceeds 250 mV in peak-to-peak voltage, or the output voltage exceeds 750 mV. The vehicle speed detecting circuit 50 produces a high level output when at least one pulse for ½ second is sent from the vehicle speed pulse generator 22, and otherwise produces a low level output. The outputs of the circuits 49 and 50 are applied to OR gate 51 and the output of the OR gate is applied to the other input of AND gate 52. The output of the OR gate 45 is applied to the change-over switch 38.

When the $O_2$ sensor 19 is activated, the $O_2$ sensor condition detecting circuit 49 produces a high level output. In normal driving conditions, the output of timer 44 is at a low level. Accordingly, the output of AND gate 52 is at a high level, so that the flip-flop 48 is reset. Thus, the output of the OR gate 45 is at a low level which operates the changeover switch 38 to connect the output of the pulse generating circuit 34 to the input of the driver 36. Thus, the air-fuel ratio is controlled by feedback control operation.

Explaining restart operation, when engine speed is below 200 rpm, the output of timer 44 is at a high level which is applied to the changeover switch 38 through the OR gate 45. The changeover switch is operated to connect the output of the fixed duty ratio generating circuit 37 to the driver 36. When the temperature of the coolant is higher than 80° C. while the output of the timer 44 is at the high level, the output of coolant temperature detecting circuit 46 is at a high level. Accordingly, the AND gate 47 produces a high level output which sets the flip-flop 48. Thus, the changeover switch 38 remains in restarting condition at high engine temperature. Under such a restarting condition, one of the switching circuits **41*a*–41*n* responds to the output of the coolant temperature sensor 20 at its predetermined temperature. Circuit 41*a* operates at 85° C. and circuit 41*n*** operates at 100° C.

Figure 3:
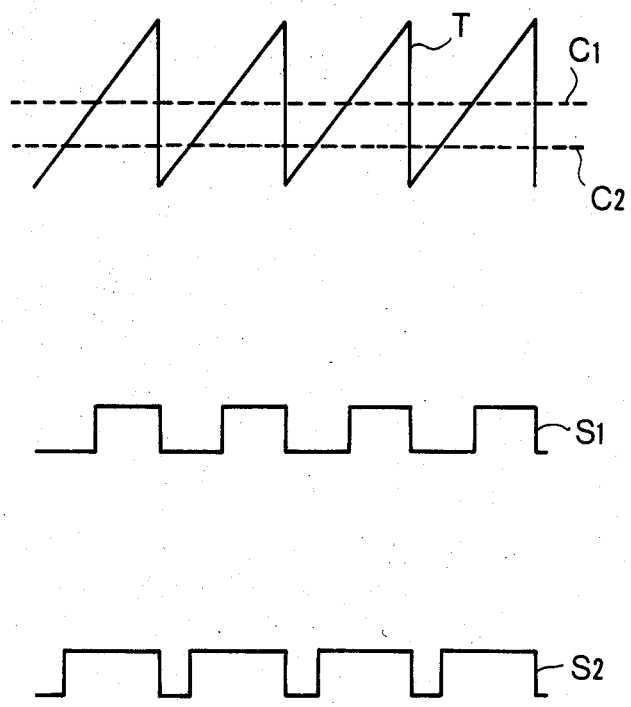
FIG. 3 shows waveforms in a fixed duty ratio generating circuit.
Figure 4A:
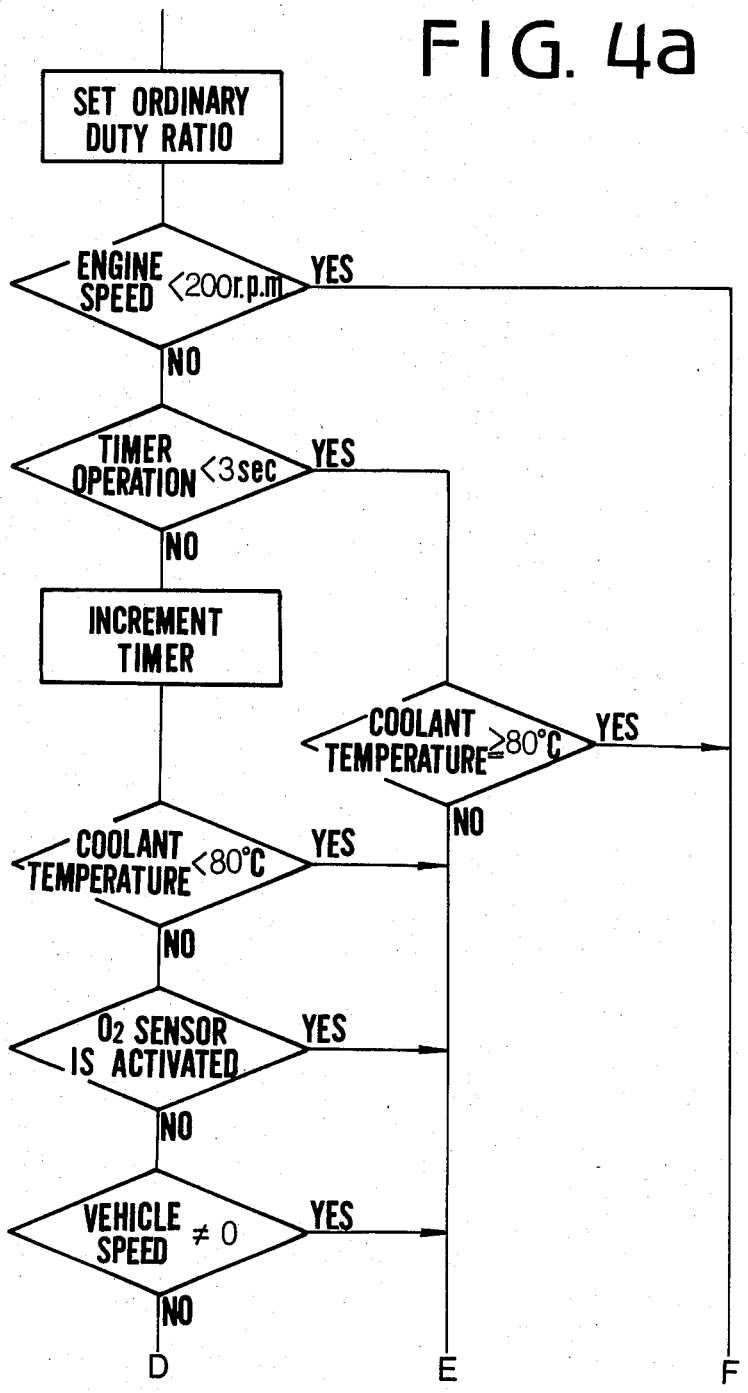
FIGS. 4*a* and 4*b* show a flowchart showing the operation of the system.
Figure 4B:
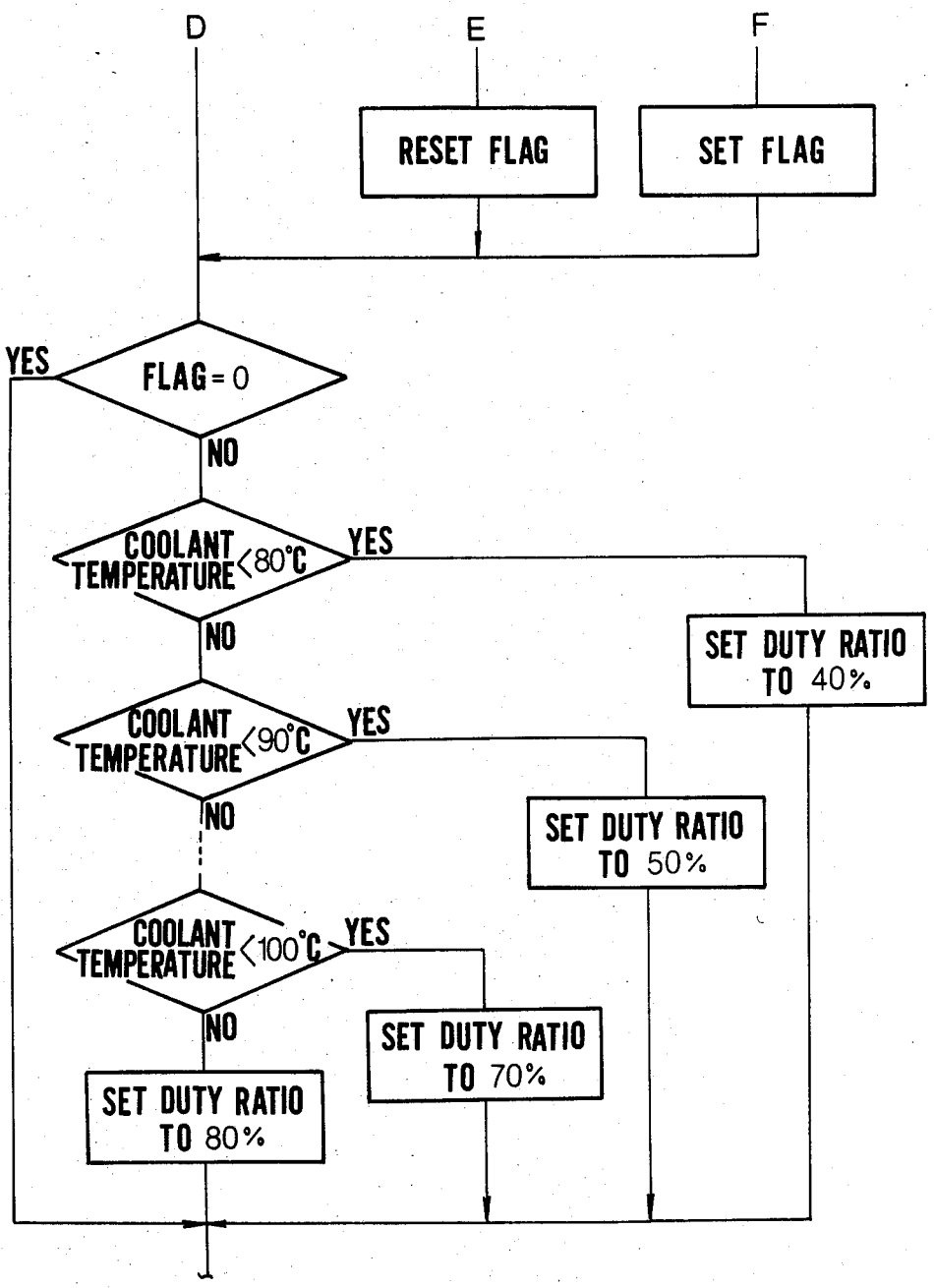

Referring to FIG. 3, reference T shows triangular wave pulses from the triangular wave pulse generator 40, and references $C_1$ and $C_2$ are reference voltages at coolant temperatures of 85° C. and 100° C. when circuits **41*a* and 41*n* operate. In accordance with the level of reference voltage, the comparator 42** produces square pulses $S_1$ and $S_2$ having duty ratios which are dependent on the coolant temperature. The duty ratios for various coolant temperatures are, for example, as follows.

| Coolant temperature | Duty ratio |
|---|---|
| Below 85° C. | 40% |
| 85° C.–90° C. | 50% |
| 90° C.–95° C. | 60% |
| 95° C.–100° C. | 70% |
| Over 100° C. | 80% |

The square pulses are applied to electromagnetic valves 14 and 15 through the changeover switch 38 and driver 36 to correct the air-fuel ratio to prevent extreme enrichment of the mixture. After a three seconds lapse, the level of output of timer 44 becomes low. If the coolant temperature decreases below 80° C., or the $O_2$ sensor 19 is activated, or vehicle speed exceeds a predetermined value, the output of the OR gate 51 goes to a high level. Accordingly, the AND gate 52 produces a high level output to reset the flip-flop 48. Thus, the changeover switch 38 is operated to cut off the input from the fixed duty ratio generating circuit 37 and to connect the output of the pulse generating circuit 34 to the driver 36, thereby establishing the feedback control system.

FIGS. **4*a* and 4*b*** show operation in a system comprising a microcomputer in accordance with the present invention.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. In a vehicle having an air-fuel ratio control system for an internal combustion engine having an induction passage, means for supplying air-fuel mixture to the engine via the induction passage, an electromagnetic valve for correcting the air-fuel ratio of the air-fuel mixture supplied by the supply means, an $O_2$ sensor for detecting oxygen concentration in exhaust gases of the engine, an ignition pulse generator for producing an engine speed signal, a coolant temperature sensor for sensing temperature of coolant of the engine, and a feedback control circuit including comparator means for comparing the output of the $O_2$ sensor with a reference value and for producing an output signal responsive to the comparison, the feedback control circuit including pulse generating circuit means responsive to the output signal of the comparator means for generating first pulses having a duty ratio which is dependent on the output signal of the comparator means, the first pulses being for driving the electromagnetic valve to correct the air-fuel ratio, the improvement comprising:

an engine restart detecting means including an engine speed detecting circuit for producing a restart signal when the engine speed signal is below a predetermined value;

second pulse generating means responsive to a signal of the coolant temperature sensor for producing second pulses having a duty ratio which is dependent on the coolant temperature;

switching means responsive to the restart signal for exclusively supplying the second pulses to the electromagnetic valve, the second pulses operating the electromagnetic valve dependent on the coolant temperature so as to prevent extreme enrichment of the air-fuel mixture.

2. The air-fuel ratio control system according to claim 1, further comprising a coolant temperature detecting circuit for producing a temperature signal when the coolant temperature is higher than a predetermined temperature;

$O_2$ sensor condition detecting means for producing an activation signal when the output voltage of the $O_2$ sensor reaches an activating value, a flip-flop for driving said switching means, said flip-flop being responsive to the engine speed signal below said predetermined value and the temperature signal for also producing said restart signal for activating the switching means, and gate means responsive to the activation signal for producing a reset signal for resetting the flip-flop so as to reset the switching means to provide the feedback control by the feedback control circuit.

3. The air-fuel ratio control system according to claim 2, wherein said gate means also produces said reset signal for resetting the flip-flop so as to reset the switching means to provide the feedback control by the feedback control circuit when the coolant temperature drops lower than said predetermined temperature.

4. The air-fuel ratio control system according to claim 2, wherein said gate means also produces said reset signal for resetting the flip-flop so as to reset the switching means to provide the feedback control by the feedback control circuit when vehicle speed exceeds a predetermined value.

5. In an air-fuel ratio control system for an internal combustion engine having an induction passage, air-fuel mixture supplying means including an electromagnetic valve for providing a desired air-fuel ratio via the induction passage to the engine, an $O_2$ sensor for detecting oxygen concentration in exhaust gases of the engine, an ignition pulse generator coupled to the engine for producing an engine speed signal, a coolant temperature sensor for sensing temperature of coolant of the engine, and a feedback control circuit including comparator means for comparing an output of the $O_2$ sensor with a reference value, the feedback control circuit including pulse generating circuit means responsive to an output comparison signal of the comparator means for generating first pulses having a duty ratio which is dependent on said comparison signal, and means for applying the first pulses to the electromagnetic valve to adjust the air-fuel ratio, the improvement comprising:

an engine speed detector of the engine speed signal for producing a restart signal when the engine speed signal is below a predetermined value;

coolant signal means responsive to an output signal of the coolant temperature sensor for producing second pulses having a duty ratio which is a function of the coolant temperature; and switching means responsive to the restart signal for exclusively supplying the second pulses to the electromagnetic valve, thereby to prevent extreme enrichment of the air-fuel mixture.

6. In an air-fuel ratio control system for an internal combustion engine having an induction passage, air-fuel mixture supplying means including an electromagnetic valve for providing a desired air-fuel ratio via the induction passage to the engine, an $O_2$ sensor for detecting oxygen concentration in exhaust gases of the engine, an ignition pulse generator coupled to the engine for producing an engine speed signal, a coolant temperature sensor for sensing temperature of coolant of the engine, and a feedback control circuit including comparator means for comparing an output of the $O_2$ sensor with a reference value, the feedback control circuit including pulse generating circuit means responsive to an output comparison signal of the comparator means for generating first pulses having a duty ratio which is dependent on said comparison signal, and means for applying the first pulses to the electromagnetic valve to adjust the air-fuel ratio, the improvement comprising:

means for generating a restart signal when restarting the engine when the engine temperature is above a predetermined temperature, until the $O_2$ sensor is activated upon reaching its activation temperature;

means for generating second pulses; and switching means responsive to the restart signal for exclusively supplying the second pulses to the electromagnetic valve so as to prevent extreme enrichment of the air-fuel mixture.

7. The air-fuel ratio control system according to claim 6, wherein said $O_2$ sensor is mounted on an exhaust system of the engine.

8. The air-fuel ratio control system according to claim 6, wherein said generating means is a coolant signal means responsive to an output signal of the coolant temperature sensor for producing said second pulses having a duty ratio which is a function of the coolant temperature.

* * * * *